United States Patent [19]

Ito

[11] 4,265,605

[45] May 5, 1981

[54] ROTARY PUMP WITH WEDGE ROLLER ECCENTRIC MEANS DRIVING THE ROTOR

[76] Inventor: Kazuichi Ito, 4, 1463-banchi, Ichibu-cho, Ikoma-shi, Nara-ken, Japan

[21] Appl. No.: 22,265

[22] Filed: Mar. 20, 1979

[30] Foreign Application Priority Data

Apr. 11, 1978 [JP] Japan ..... 53/42824

[51] Int. Cl.[3] ..... F04C 18/00; F04C 27/00

[52] U.S. Cl. ..... 418/63; 418/64; 403/351

[58] Field of Search ..... 418/57, 63–67, 418/182; 403/350, 351

[56] References Cited

U.S. PATENT DOCUMENTS

| | | | |
|---|---|---|---|
| 883,559 | 3/1908 | McGregor et al. | 403/350 |
| 2,460,617 | 2/1949 | Balogh | 418/57 |
| 3,025,801 | 3/1962 | Paikert | 418/66 |
| 3,194,167 | 7/1965 | Wilson | 418/66 |

FOREIGN PATENT DOCUMENTS

| | | | |
|---|---|---|---|
| 678936 | 7/1939 | Fed. Rep. of Germany | 418/66 |
| 829554 | 1/1952 | Fed. Rep. of Germany | 418/64 |
| 1985 | of 1876 | United Kingdom | 418/64 |
| 5217 | of 1897 | United Kingdom | 403/351 |
| 420787 | 12/1934 | United Kingdom | 403/351 |

*Primary Examiner*—John J. Vrablik

*Attorney, Agent, or Firm*—Haseltine and Lake

[57] ABSTRACT

An improved rotary pump designed to ensure a high pumping efficiency and delivery pressure without any unfavorable pulsation thereof. The pump includes a pump shaft drivably coupled to a prime mover and provided with a groove having a bottom surface extending in parallel with the axis of said shaft, and an eccentric rotor received in a cylindrical chamber for pumping of fluid and arranged to surround through a bearing said pump shaft for eccentric movement relative to said pump shaft while keeping a sealing contact with the wall of said cylindrical chamber. One or more wedge roller is disposed between said groove bottom surface and said bearing for effective power transmission from said pump shaft to said eccentric rotor. Between the cylindrical chamber wall and said eccentric rotor, there is formed a pump chamber which is sealingly divided by a partition member into a suction chamber and a delivery chamber.

The pump may further include one or more diaphragm(s) disposed between said cylindrical chamber wall and said eccentric rotor on one or opposite side(s) thereof for sealing said pump chamber.

6 Claims, 10 Drawing Figures

ROTARY PUMP WITH WEDGE ROLLER ECCENTRIC MEANS DRIVING THE ROTOR

BACKGROUND OF THE INVENTION

The present invention relates to a rotary pump and, more particularly, to a rotary pump having an eccentric rotor adapted to make an eccentric motion relatively to the axis of the pump shaft, so as to cause a pumping action in a pump chamber formed in a pump casing.

Generally, in the rotary pump in which the pumping action is performed by an eccentric rotation of an eccentric rotor accommodated in a pump casing, the eccentric rotor is rotated by the torque transmitted from the pump shaft, while being pressed in the direction of the eccentricity so as to make a sliding contact with the inner peripheral surface of the pump chamber. In order to achieve a high pump efficiency, it is desirable that the eccentric rotor makes the eccentric rotation keeping a sliding contact with the inner peripheral surface of the pump casing, while being pressed strongly in the direction of the eccentricity. At the same time, it is desirable that the pump casing is completely sealed to avoid the external leak of the pumped fluid.

SUMMARY OF THE INVENTION

It is therefore a major object of the invention to provide a constant-displacement rotary pump in which the eccentric rotor can receive a large force in both of circumferential and eccentric directions from the pump shaft, so as to ensure a high efficiency and delivery pressure, while avoiding unfavourable pulsation of the delivery pressure.

It is another object of the invention to provide a rotary pump in which no valve is used in the fluid passage, so as to avoid the reduction of the efficiency which might, for otherwise, be caused during high speed operation of the pump.

It is still another object of the invention to improve the working efficiency of the pump, through diminishing as much as possible the frictional loss of power transmitted from the pump shaft to the eccentric rotor, through nullifying the friction between the eccentric rotor and the inner peripheral surface of a cylindrical hollow chamber, by arranging such that the eccentric rotor can rotate freely with respect to the pump casing, i.e. rotatably around the axis of its own, and that the eccentric rotor can make an eccentric planet-like rotation with respect to the pump shaft, while making slideless rolling contact with the inner peripheral surface of the pump chamber, by making use of a wedge action of wedge roller means.

It is a further object of the invention to provide a rotary pump which can be most suitably used for pressurizing and delivering such specific fluids as would be degraded when contacted by atmosphere or lubricant, or would cause a danger when leaked to the outside of the pump, thanks to a provision of diaphragm means disposed between the eccentric rotor and the pump casing so as to seal the pump chamber in a fluid-tight manner.

It is a still further object of the invention to improve the durability of the diaphragm means disposed between the eccentric rotor and the pump casing by arranging the rotor that it can make an eccentric movement around the pump shaft but cannot rotate around its own axis so as to avoid application of circumferential twisting force to the diaphragm during the eccentric movement of the eccentric rotor.

It is a still further object of the invention to provide a rotary pump in which a partition member is attached to the pump casing and constructed to have a cylindrical form, the entire outer peripheral surface of the partition member being closely fitted to the entire inner peripheral surface of an insert adapted to be received in a partition groove formed in the eccentric rotor for free sliding movement in the radial direction, so as to avoid the local wear which may, for otherwise, be caused by the frictional engagement of the partition member and the insert during the eccentric movement of the eccentric rotor, thereby to improve the durability of the pump.

It is a still further object of the invention to reduce the number of parts and simplify the construction of the pump as much as possible, by arranging such that the partition member serves also as means for preventing the eccentric rotor from rotating around the axis of its own.

These and other objects, as well as operation and advantages of the invention will become clear from the following description of the preferred embodiments taken in conjunction with the accompanying drawings.

BRIEF DESCIPTION OF THE DRAWINGS

FIGS. 1 to 3 in combination show a fast embodiment of a rotary pump in accordance with the invention in which:

FIGS. 5 and 7 in combination show a rotary pump which is a third embodiment of the invention in which:

FIG. 5 is a sectional view taken along the line V—V of FIG. 6,

FIG. 7 is a sectional view taken along the line VII—VII of FIG. 5.

DESCRIPTION OF THE PREFERRED EMBODIMENTS

Figure 1:
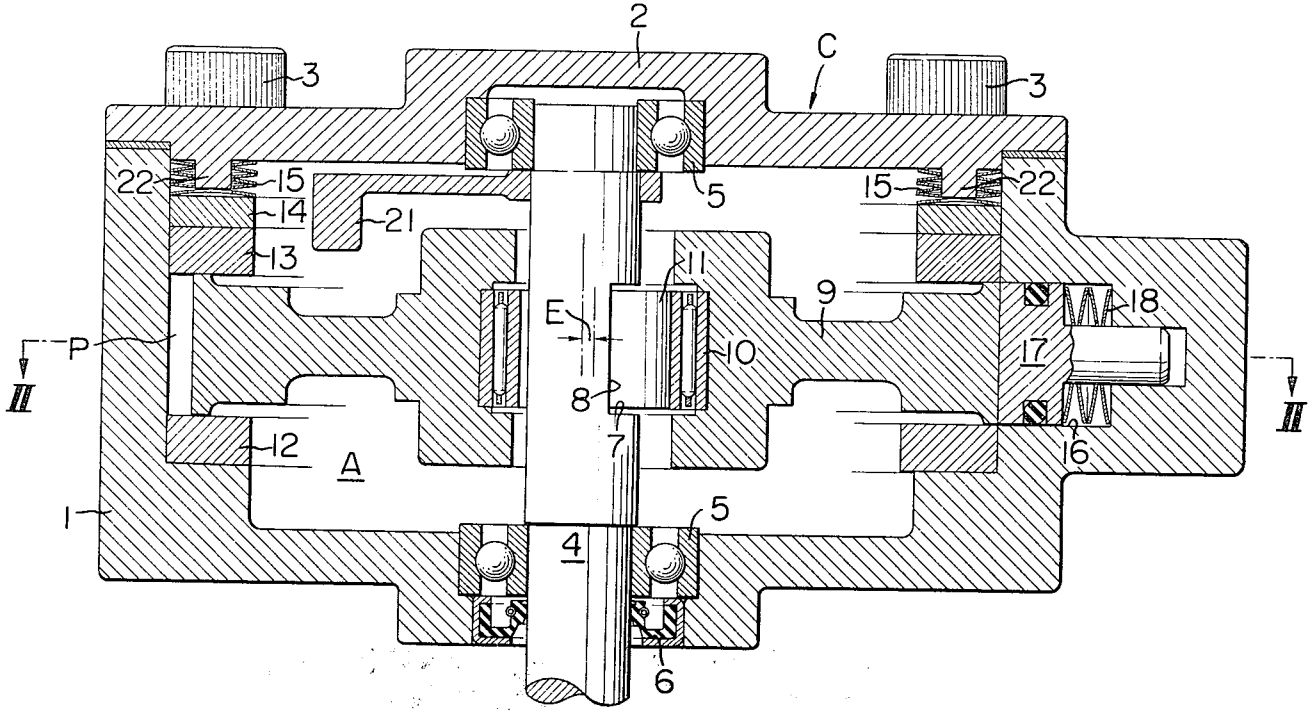
FIG. 1 is a sectional view taken along line I—I of FIG. 2.
Figure 2:
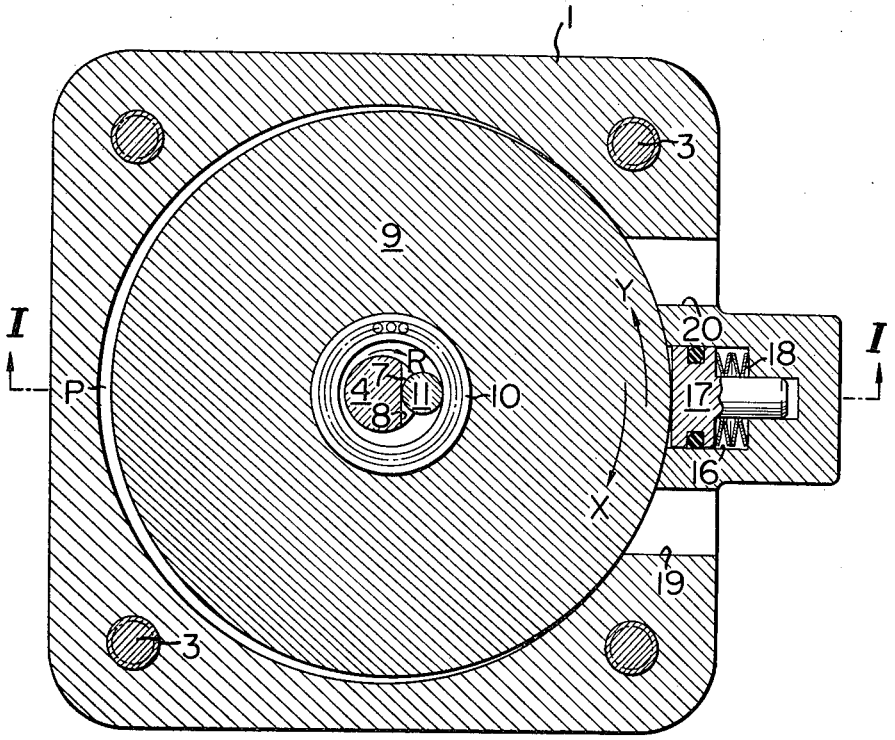
FIG. 2 is a sectional view taken along the line II—II of FIG. 1.

Referring first to FIGS. 1 and 2 showing a first embodiment of the invention, a pump casing C is constituted by a case body 1 opened at its one side, and a closure body 2 unitarily connected to the case body 1 by means of a plurality of bolts 3 so as to close the opening of the case body 1. A cylindrical chamber A is formed in the pump casing C. A pump shaft 4 extends through the pump casing C, along the axis of the latter. The pump shaft 4 is rotatably supported at its mid portion and outer end portion, by means of respective bearings 5,5. At the same time, a seal member 6 is disposed between the pump shaft 4 and the end surface of the case body 1, so as to seal the chamber A from the outside of the pump. The pump shaft 4 is connected at its end extending out of the pump casing C to a prime mover which is not shown, so as to be forcibly driven by the latter.

The portion of the pump shaft 4 in the cylindrical chamber A has a recessed groove 7 having a bottom surface 8 which extends in parallel with the central axis of the pump shaft 4. An eccentric rotor 9 is carried by the pump shaft 4 so as to surround the groove 7, through a bearing 10 disposed therebetween. A wedge roller 11 is interposed between the flat bottom surface 8 of the grooe 7 and the inner peripheral surface of the hearing 10. An eccentricity E is therefore formed between the axis of the pump shaft 4 and the axis of the eccentric rotor 9.

Therefore, as the pump shaft 4 rotates, the wedge roller 11 is wedged into the space between the flat bottom surface 8 of the groove 7 and the inner peripheral surface of the bearing 10, so that the eccentric rotor 9 makes a planet-like rotation in slidless contact with the inner peripheral surface of the case body 1, while being pressed in the circumferential direction and the eccentric direction by the pump shaft 4. A seal ring 12 is disposed between the inner peripheral surface of the case body 1 and one side surface of the peripheral portion of the eccentric rotor 9. At the opposite side of the eccentric rotor 9, disposed between the eccentric rotor 9 and the inner surface of the closure body 2 are another seal ring 13, a buck-up ring 14 and a plurality of compression springs 15. The compression springs 15 are fitted over and supported by respective one of a plurality of projections 22 formed on the inner surface of the closure 2. As a result, the resilient forces exerted by the compression springs 15 act to press the seal rings 12, 13 onto the side surfaces of the eccentric rotor 9 at the outer peripheral portion of the latter, such that a fluid-tight crescent-shaped pump chamber P is formed between the inner peripheral surface of the pump casing 1, outer peripheral surface of the eccentric. rotor 9 and the seal rings 12, 13.

A partition groove 16 opening into the cylindrical chamber A is formed in the case body 1. A piston-like partition member 17 is slidably received in the partition groove 16. The partition member 17 is biased toward the inside of the cylindrical chamber A, by a compression spring 18 disposed in the partition groove 16. The end surface of the partition member 17 is kept in pressure contact with the outer peripheral surface of the eccentric rotor 9, substantially at a right angle to the latter. As will be described later, the crescent-like pump chamber P is divided into an intake (suction) chamber Pi and an exhaust (delivery) chamber Pe (See FIGS. 3B,3C and 3D), by the partition member 17. An intake and an exhaust port 19 and 20 are formed in the case body 1 to open into the cylindrical chamber A, at both sides of the partition member 17. A balance weight 21 is fixed to the pump shaft 4, at one side of the eccentric rotor 9.

Figure 3A:
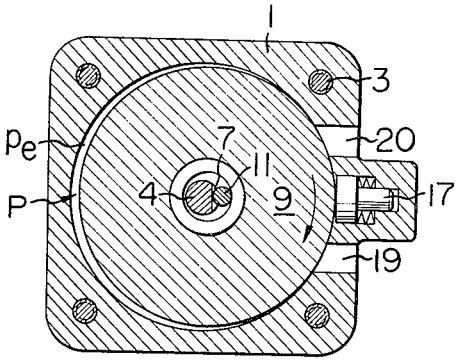
FIGS. 3A,3B,3C and 3D are illustrations of operation of the pump as shown in FIGS. 1 and 2.
Figure 3C:
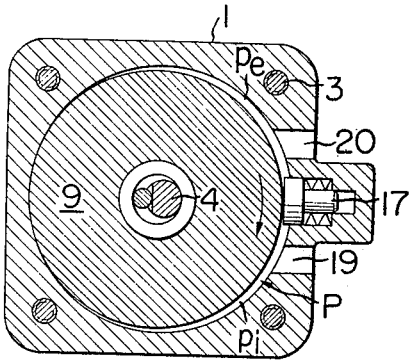
Figure 3B:
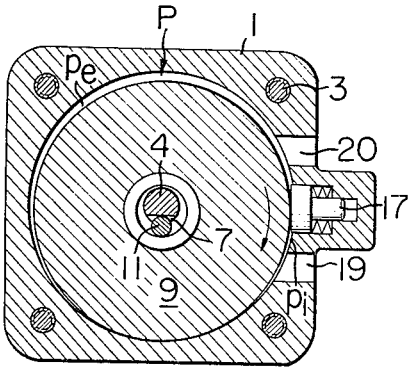
Figure 3D:
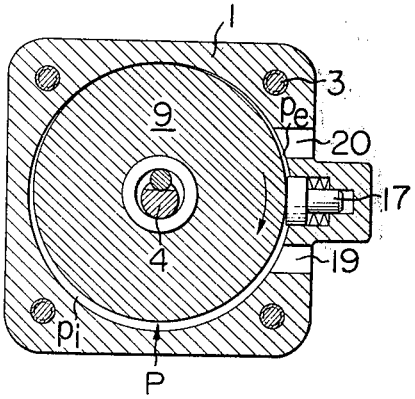

With the above-described arrangement, as the pump shaft 4 is rotated clockwise as viewed on FIG. 2 by a prime mover not shown, the torque is transmitted to the wedge roller 11 through the flat bottom surface of the groove 7, and further to the bearing 10 through the wedging action. In the course of this torque transmission, the bearing 10 is pressed in the direction of the eccentricity, and this pressing force is directly transmitted to the eccentric rotor 9. As a result, the eccentric rotor 9 makes a slideless rolling contact with the inner peripheral surface of the pump casing C in a planet-like manner, while being pressed onto the inner peripheral surface of the pump casing C. Namely, the eccentric rotor 9 rotates around its axis in the counter-clockwise direction (direction of arrow Y) and revolves in the clockwise direction (direction of arrow X) around the axis of the pump shaft 4, as viewed on FIG. 2. Meanwhile, the partition member 17 follows the planet-like movement of the eccentric rotor 9, while being pressed against the outer peripheral surface of the eccentric rotor 9 by the force of the spring 18, and divides the crescent-shaped pump chamber P into the suction and the delivery chambers Pi,Pe. The volume of these intake and exhaust chambers are changed by the planet-like rotation of the eccentric rotor 9, so as to cause a pumping action. In the state in which the eccentric rotor 9 is positioned at the top dead center of its stroke, i.e. the position where the eccentric rotor is closest to the suction and the delivery ports 19,20, as shown in FIGS. 2 and 3A, the volume of the suction chamber Pi leading to the suction port 19 is minimum and the chamber Pi is just to commence its suction stroke, whereas the volume of the delivery chamber Pe has been expanded to the maximum, and the delivery chamber is just to commence the delivery. As the eccentric rotor 9 is rotated from this state in the manner described before, the volume of the suction chamber Pi is gradually increased as shown in FIG. 3B, so as to suck the fluid, whereas the volume of the delivery chamber Pe is gradually decreased and comes into communication with the delivery port 20, so that the fluid in the chamber Pe is compressed and delivered through the delivery port 20. Then, as the eccentric rotor 9 reaches the bottom dead center where the distance between the eccentric rotor 9 and the ports 19,20 is the maximum, the volumes of the suction chamber Pi and the delivery chamber Pe come substantially equal to each other. In this state, these suction and delivery chambers Pi,Pe are on the midway of the suction and the delivery strokes, respectively. As the eccentric rotor 9 further rotates, the suction chamber Pi further increases the volume, while the delivery chamber Pe further decreases its volume as shown in FIG. 3C, so that these chambers come to resume the state as shown in FIG. 3A, thus completing the suction and the delivery strokes. A cycle of pumping action including the suction and delivery strokes is achieved by each rotation of the eccentric rotor 9, and a fluid of a volume equal to the volume of the pump chamber P is displaced and delivered.

Figure 4:
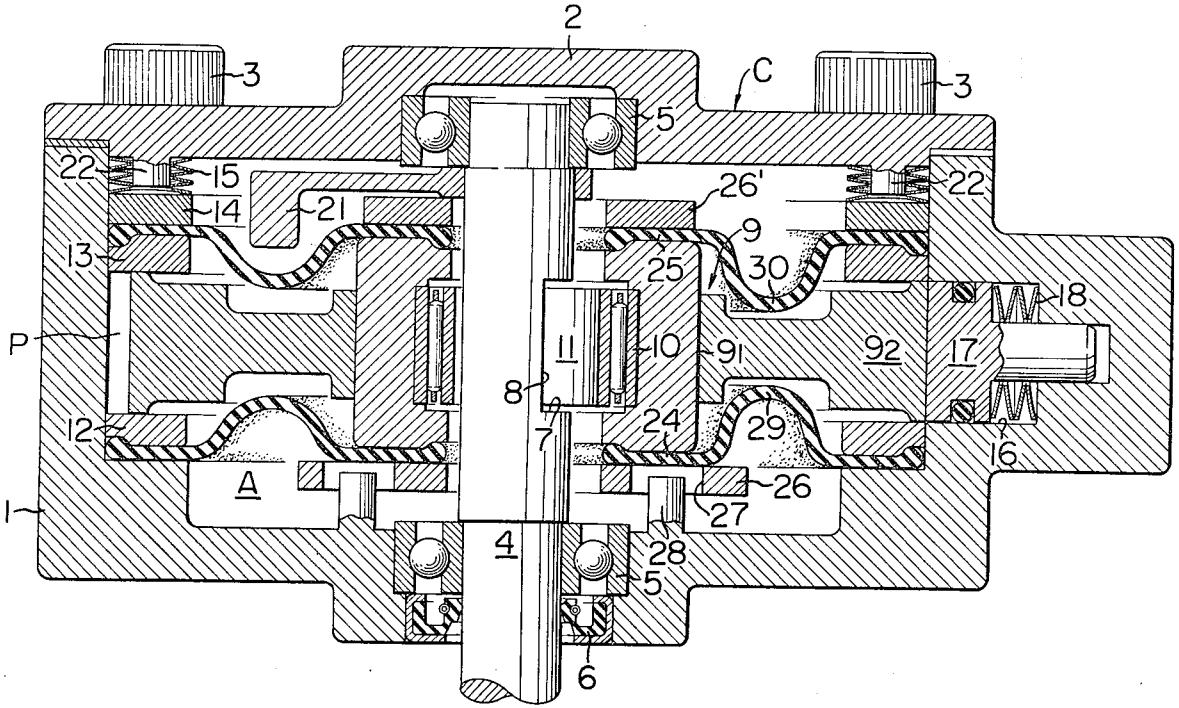
FIG. 4 is a view similar to that of FIG. 1 but showing a rotary pump in accordance with a second embodiment of the invention.

FIG. 4 shows a second embodiment of the invention in which the eccentric rotor 9 is constituted by an inner rotor $9_1$ and an outer rotor $9_2$. The inner peripheral surface of the inner race $9_1$ is fitted in the outer race of the bearing 10, while the outer rotor $9_2$ is rotatably fitted at its inner peripheral surface to the outer peripheral surface of the inner rotor $9_1$. A pair of disc-shaped flexible diaphragms 24,25 are attached in a symmetric manner to respective sides of the eccentric rotor 9 constituted by the inner and outer rotors $9_1$,$9_2$. The diaphragms are made of rubber, a plastic or a metal such as stain hastelloy. These diaphragms 24,25 are clamped at their inner peripheral edges by means of a pair of clamping rings 26,26' attached to the outer surface of the inner rotor $9_1$ and both sides of the latter. The outer peripheral edge of the diaphragms 24,25 are clamped between the seal ring 12 and the case body 1 or between the seal ring 13 and the buck-up ring 14. One 26 of the clamping rings has a larger diameter than the other 26', and is provided with a plurality of through bores 27 loosely receiving projections 28 projecting from the inner surface of the case body 1.

Expandable areas 29,30 are provided at intermediates of the pair of diaphragms 24,25, so as to absorb the difference of movement between the outer and inner peripheral portions of each diaphragm 24,25. The difference of movement between the inner and outer peripheral portions of each diaphragm will be absorbed most effectively and conveniently, if each diaphragm is constructed in the form of a bellows.

Thus, the pair of diaphragms 24,25 completely seals both sides of the eccentric rotor 9. Therefore, even if the fluid is allowed to leak through the gap between the seal rings 12,13 and the eccentric rotor 9, the leaked fluid is confined within the chamber sealed by the pair of diaphragms 24,25, and is prevented from leaking to the outside of the pump case.

Figure 5:
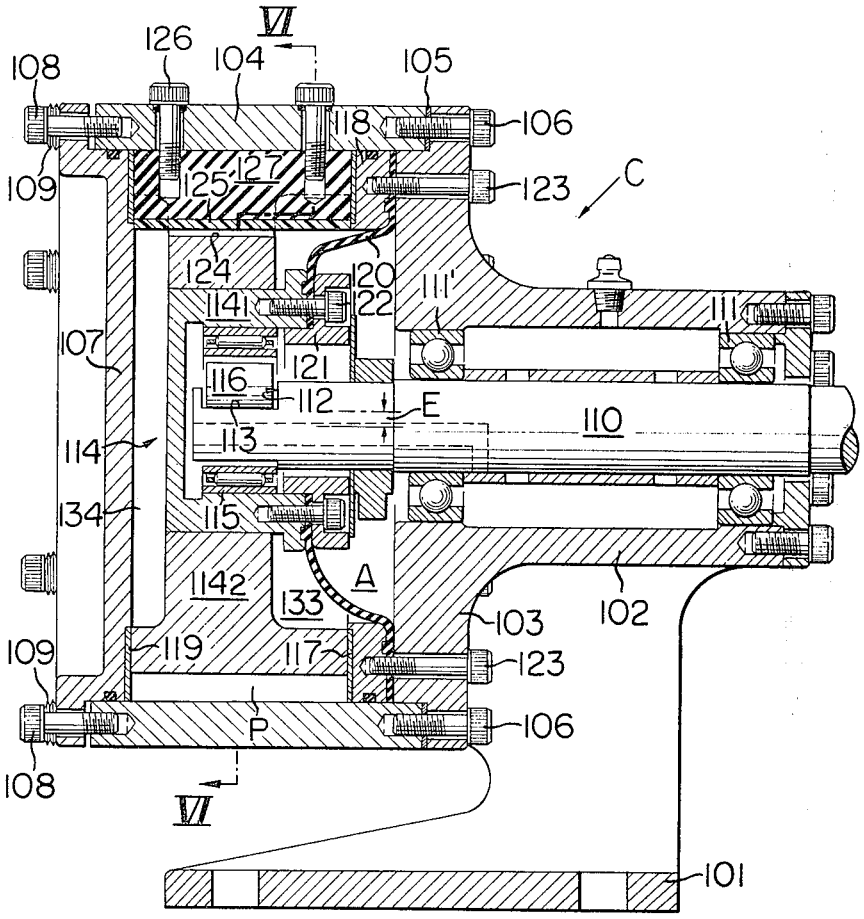
Figure 6:
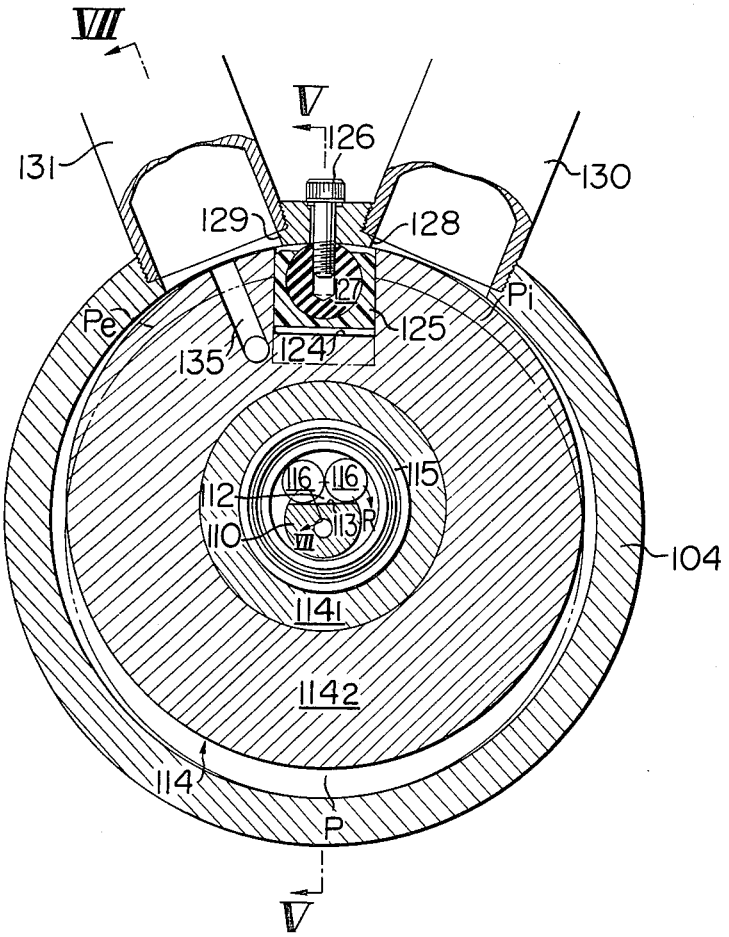
FIG. 6 is a sectional view taken along the line VI—VI of FIG. 5.
Figure 7:
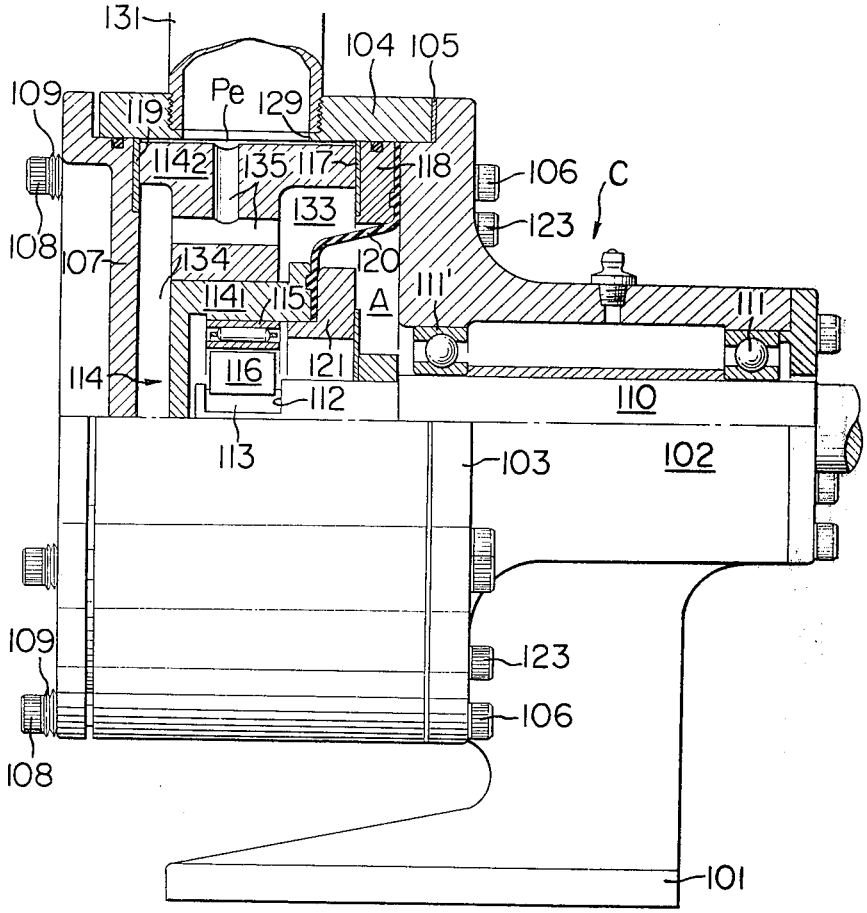

FIGS. 5 to 7 in combination show a third embodiment of the invention. In this embodiment, a reference numeral 101 denotes a base having a hollow cylindrical part 102 and a flange 103 formed unitarily with the latter. A hollow cylindrical case body 104 is fixed to the flange 103, through a medium of seal rings 105, by means of a plurality of bolts 106. At the same time, a closure member 107 is attached resiliently by means of a plurality of bolts 108 and springs 109. The base 101, case body 104 and the closure member 107 in combination constitute a pump casing C having a cylindrical chamber A therein. A pump shaft 110, which extends at its one end to the cylindrical chamber A and connected at its other end to a prime mover not shown, is rotatably mounted on the base 101, through the mediums of bearings 111,111'.

The portion of the pump shaft 110 extending in the cylindrical chamber A is provided with a groove 112 having a flat bottom surface 113 which extends in parallel with the central axis of the pump shaft 110. An eccentric rotor 114 constituted by an inner rotor $114_1$ and an outer rotor $114_2$ is rotatably carried by the pump shaft 110 at a portion of the latter where the groove 112 is formed, through the medium of a bearing 115 and wedge rollers 116.

Between one side of the peripheral portion of the outer rotor $114_2$ and the inner surface of the flange 103 of the base 101, disposed is a seal ring 117 and a buck-up ring 118. Another seal ring 119 is disposed between the other side of the peripheral portion of the outer rotor $114_2$ and the closure member 107. These seal rings 117 and 119 are presented by springs 109 resiliently against respective side surfaces of the outer rotor $114_2$. Thus, the inner surfaces of the seal rings 117,119, inner peripheral surface of the case body 104 and the outer peripheral surface of the outer rotor $114_2$ in combination define a crescent-shaped pump chamber P which is sealed in a fluid-tight manner.

A flexible disc-shaped diaphragm 120 is disposed at the side of the eccentric rotor 114 closer to the flange 103. The inner peripheral portion of the diaphragm 120 is clamped between the opened end of the cup-shaped inner rotor 114 and a clamping ring 121, by means of a plurality of fixing bolts 122. At the same time, the outer peripheral portion of the diaphragm 120 is clamped between a clamp ring 118 and the inner surface of the flange portion 103 of the base 101, by means of a plurality of bolts 123.

An axially-extending partition groove 124 having a rectangular cross-section is formed in the outer rotor $114_2$. An insert 125 having a substantially cylindrical inner peripheral surface is slidably received in the partition groove 124, in a fluid-tight manner and slidably in the radial direction. A partition member 127 is fitted to the inner peripheral surface of the insert 125 for free rotation relatively to the latter. The partition member 127 is secured in a sealing manner to the case body 104, by means of a bolt 126, and is contacted at its upper and lower ends in a sealing manner by means of seal rings 117,119. At least one of the partition member 127 and the insert 125 is made of a resilient or elastic material such as rubber, plastic or the like, so that the whole part of the outer peripheral surface of the partition member 127 may closely contact the whole part of the inner peripheral surface of the insert 125, thereby to attain a fluid-tight seal therebetween.

According to this construction, the outer rotor $114_2$ is allowed to make a rotation relatively to the partition member 127 fixed to the case body, around the partition member 127, and to make a radial sliding movement relatively to the insert 125. As a result, the outer rotor $114_2$ is allowed to make an eccentric movement relatively to the pump shaft 110, but is prevented from rotating around its axis. Therefore, as the pump shaft 110 is rotated, the inner rotor $114_1$ makes an eccentric oscillation around the pump shaft 110, due to the wedging action of the wedge rollers 116. At the same time, the outer rotor $114_2$ rotatably fitted around the periphery of the inner rotor $114_1$ makes an eccentric oscillation around the pump shaft 110, while making a contact with the inner peripheral surface of the case body 104, thereby to effect a pumping action in the same manner as the first and the second embodiments which have been described already. In accordance with the eccentric oscillation of the outer rotor $114_2$, the crescent-shaped pump chamber P is divided by the partition member 127 into a suction champer Pi and the delivery chamber Pe, as shown by the chain line in FIG. 6.

A suction port 128 and a delivery port 129 open in the cylindrical chamber A at respective sides of the partition member 127 of the case body 104. A suction pipe 130 and a delivery pipe 131 are screwed to the suction port 128 and the delivery port 129.

At the same time, as shown in FIG. 7, a chamber 133 formed between the diaphragm 120 and the eccentric rotor 114, and a chamber 134 formed between the eccentric rotor 114 and the closure member 107 are in communication with the delivery chamber Pe through a passage 135 formed in the outer rotor $114_2$.

Therefore, even when the fluid in the pump chamber 9 has happened to leak through the gap between the eccentric rotor 114 and the seal rings 117,119, the leaked fluid flows into the chamber 133 defined by the diaphragm 120 and the eccentric rotor 114, and the chamber 134 defined by the eccentric rotor 114 and the closure member 107, and then flows back to the delivery chamber Pe through the passage 135. Therefore, it does never takes place that the leaked fluid comes into the space between the inner rotor $114_1$ and the pump shaft 110 where the bearing 115 and the wedge roller 116 are disposed to be mixed with the lubricant in that space, nor that the fluid leaks outside of the pump through the bearings 111,111' which are disposed between the base 101 and the pump shaft 110. Further, it is fairly avoided that the chambers 133,134 are filled with leaked fluid to excessively load the diaphragm 120.

What is claimed is:

1. A rotary pump comprising: a pump casing having a cylindrical chamber formed therein; a pump shaft rotatably carried by said pump casing and provided at its portion extending in said cylindrical chamber with a groove having a bottom surface extending in parallel with the central axis of said pump shaft; an eccentric rotor surrounding said pump shaft at a portion of the latter where said groove is formed and adapted to make an eccentric movement in relation to said pump shaft while keeping a contact with the inner peripheral surface of said cylindrical chamber; a roller bearing positioned coaxially within a central bore of said rotor; wedge roller means disposed between said bottom surface of said groove and said bearing for imparting through said bearing an eccentric movement to said bearing and thus to said rotor, said wedge roller having a diameter of greater extent than the depth the groove; a partition means adapted to divide a pump chamber formed between said pump casing and said eccentric rotor in a fluid-tight manner into a suction chamber and a delivery chamber; and a suction port and a delivery port formed in said pump casing and communicating with said suction chamber and said delivery chamber, respectively.

2. A rotary pump as claimed in claim 1, wherein said eccentric rotor is disposed for free rotation relatively to said pump casing, and said pump casing is formed with a partition groove which opens into the pump chamber while said partition means includes a partition member received in a fluid tight manner in said partition groove, and resilient means biasing said partition member toward said eccentric rotor into pressure contact with the outer peripheral surface thereof so as to form a fluid-tight seal.

3. A rotary pump as claimed in claim 1, wherein said wedge roller means projects outwardly from the outermost periphery of said pump shaft only at one side thereof so as to place said eccentric rotor in eccentric relation with the center of said pump shaft.

4. A rotary pump as claimed in claim 1, comprising diaphragm means extending between said eccentric rotor and said pump casing, and means sealingly connecting said diaphragm to said rotor and casing, said diaphragm means isolating said pump chamber from the outer peripheral surface of said pump shaft and the inner peripheral surface of said eccentric rotor.

5. A rotary pump as claimed in claim 1 or 4, in which said partition means includes a partition member which is fixed to said pump casing, and said eccentric rotor includes a partition groove in which said partition member is received for free radial and rotary movement relative to said eccentric rotor.

6. A rotary pump as claimed in claim 5, wherein said partition member comprises a cylindrical member fixedly supported by said pump casing, and an insert slidable within said partition groove for radial sliding movement, said insert having an arcuate channel in which said cylindrical member is located.

* * * * *